US005340293A

United States Patent [19]

Yasuda et al.

[11] Patent Number: 5,340,293

[45] Date of Patent: Aug. 23, 1994

[54] GEAR-TYPE PUMP HAVING PRESSURE BALANCED SUPPORT

[75] Inventors: Minoru Yasuda, Chiryu; Takahiko Kato, Kariya; Motoya Ito, Anjo, all of Japan

[73] Assignee: Nippondenso Co., Ltd., Kariya, Japan

[21] Appl. No.: 968,499

[22] Filed: Oct. 29, 1992

[30] Foreign Application Priority Data

Oct. 30, 1991 [JP] Japan ..... 3-284821
Sep. 14, 1992 [JP] Japan ..... 4-244677

[51] Int. Cl.[5] ..... F01C 1/10
[52] U.S. Cl. ..... 418/171; 418/73
[58] Field of Search ..... 418/71, 73, 171; 417/423.3, 423.6, 423.12

[56] References Cited

U.S. PATENT DOCUMENTS 3,680,989 8/1972 Brundage ..... 418/71
4,445,821 5/1984 Watanabe et al. ..... 417/366
4,820,138 4/1989 Bollinger ..... 418/71

FOREIGN PATENT DOCUMENTS 60-17281 1/1985 Japan .
63-195390 8/1988 Japan .
63-223382 9/1988 Japan .
1249971 10/1989 Japan .

*Primary Examiner*—Louis J. Casaregola
*Assistant Examiner*—Charles G. Freay
*Attorney, Agent, or Firm*—Cushman, Darby & Cushman

[57] ABSTRACT

There is disclosed a trochoid pump in which a friction between a rotor and its support portion is reduced, thereby reducing a drive torque and wear of these parts. An inner rotor of the trochoid-type fuel pump is rotatably supported by a bushing through a bearing. An outer rotor is rotatably received in an inner periphery of a spacer. A first groove is formed in a portion of the outer periphery of the bushing disposed close to a discharge port, and a discharge fuel is introduced into this groove. A second groove is formed in a portion of the inner periphery of the spacer disposed close to the discharge port, and the discharge fuel is introduced into this groove. Although the inner rotor is urged toward the bushing by the fuel pressure of the discharge port, the urging force to urge the inner rotor toward the bushing is weakened by the discharge fuel introduced into the first groove, thereby reducing a friction. Although the outer rotor is urged against the spacer, the urging force to urge the outer rotor against the spacer is weakened by the discharge fuel introduced into the second groove, thereby reducing a friction.

20 Claims, 5 Drawing Sheets

GEAR-TYPE PUMP HAVING PRESSURE BALANCED SUPPORT

BACKGROUND OF THE INVENTION

This invention relates to a gear-type pump which pressurizes a fluid by the movement of pump chambers and their volume change which are caused by the rotation of an inner rotor and an outer rotor, and more particularly to such a gear-type pump best suited for a fuel pump of an automobile.

Conventional gear-type pumps are known, for example, from Japanese Patent Unexamined Publication Nos. 63-223382 and 60-17281. Such a gear-type pump comprises a rotor housing, and a pair of rotors mounted within the rotor housing. The number of teeth of the inner rotor is smaller by one than the number of teeth of the outer rotor. The inner rotor is driven and rotated to rotate the outer rotor, meshed with the inner rotor, in the same direction as the direction of rotation of the inner rotor. By doing so, a plurality of pump chambers formed between the inner and outer rotors move in such a manner that the volume of the pump chamber is changed. A fluid is drawn from an intake port provided at a region where the volume of the pump chamber is gradually increasing, and the fluid is discharged from a discharge port provided at a region where the volume of the pump chamber is gradually decreasing.

Particularly, Japanese Patent Unexamined Publication No. 60-17281 discloses a technique in which the discharge fluid is introduced between the outer rotor and the rotor housing to reduce a resistance due to a sliding friction between the outer rotor and the rotor housing.

Further, in the gear-type pump, since the pressure at the discharge port side is high, the outer rotor is strongly pressed against a part of the rotor housing to produce a partial wear. Therefore, it is known, for example, from U.S. Pat. No. 4,820,138 to introduce the discharge fluid to a predetermined position at the discharge port side to produce a counter pressure against the high pressure at the discharge port.

However, in the gear-type pumps disclosed in Japanese Patent Unexamined Publication No. 60-17281 and U.S. Pat. No. 4,820,138, the inner rotor is positioned and rotated by a rotation shaft of the motor. There has been encountered a problem that the inner rotor is not accurately positioned due to a dislocation of the motor rotation shaft and a gap between the motor rotation shaft and its mating engagement portion. As a result, the gap between the inner rotor and the outer rotor increases, which has resulted in a problem that the liquid-tightness in the pump chamber is lowered, thus lowering a pumping efficiency. In order to overcome these problems, it can be considered to support the inner rotor by a support shaft separate from the motor rotation shaft. In such a case, however, since the inner rotor rotates in contact with the support shaft, the required drive torque is increased so as to overcome the friction between the inner rotor and the support shaft, which has resulted in a problem that the motor for driving the pump consumes an increased amount of electric power. Moreover, the wear develops in the inner rotor and the support shaft, and with the increase of the wear, the shaking of the inner rotor increases, so that it has been difficult to maintain a predetermined performance for a long period of time. A further problem is that since the inner rotor is held against the support shaft from the discharge port side by the pressure of the discharge port, the wear at the discharge port side of the inner rotor is particularly increased.

SUMMARY OF THE INVENTION

With the above problems in view, it is an object of this invention to provide a gear-type pump in which an inner rotor is accurately centered, and wear of the inner rotor and its support shaft is reduced.

According to the present invention, to this end, there is provided a gear-type pump comprising: a disk-like inner rotor having external teeth formed on an outer periphery thereof, the inner rotor having a hole of a circular shape formed at an axis of rotation thereof; a disk-like annular outer rotor receiving the inner rotor therein, the outer rotor having internal teeth formed on an inner periphery thereof, the internal teeth meshing with the external teeth of the inner rotor to define therebetween a plurality of pump chambers, which are moved and changed in volume in accordance with the rotation of the inner and outer rotors to draw and discharge a fluid; a casing including a cylindrical wall rotatably receiving the outer rotor, walls respectively forming opposite side walls for the plurality of pump chambers defined between the inner and outer rotors, an intake port formed in a path of movement of the pump chambers so as to draw the fluid, and a discharge port formed in the path of movement of the pump chambers so as to discharge the fluid; a support member inserted in the circular hole in the inner rotor, the support member rotatably supporting the inner rotor in eccentric relation to the outer rotor;

Drive means for rotating the inner and outer rotors; and a pressure introduction passage provided between the inner rotor and the support men, bet at a position corresponding to an opening of the discharge port so as to introduce the discharge fluid from the discharge port.

In the above construction of the invention, the inner rotor and the outer rotor are rotated by the drive means. In accordance with the rotation of the rotors, the pump chambers defined between the inner and outer rotors are moved and changed in volume. As a result, the fluid is drawn from the intake port, and is discharged to the discharge port. In the construction of the invention, the outer rotor is positioned by the cylindrical wall of the casing, and rotates in contact with this cylindrical wall. On the other hand, the inner rotor is rotatably supported and positioned relative to the support shaft. The inner rotor rotates in contact with the support shaft. In the construction of the invention, the pressure introduction passage is provided between the inner rotor and the support shaft so as to introduce the discharge fluid from the discharge port. This pressure introduction passage is provided at a position corresponding to the opening of the discharge port so as to introduce the discharge fluid thereinto. The fluid introduced through this pressure introduction passage urges the inner rotor toward the discharge port. Therefore, the force, produced by the high-pressure fluid of the discharge port to urge the inner rotor toward the support shaft, is reduced, and the force of contact between the inner rotor and the support shaft is reduced. With this arrangement, an excessive wear of a hole formed through the inner rotor, as well as an irregular wear of the support shaft is reduced.

DETAILED DESCRIPTION OF THE PREFERRED EMBODIMENTS

Figure 1:
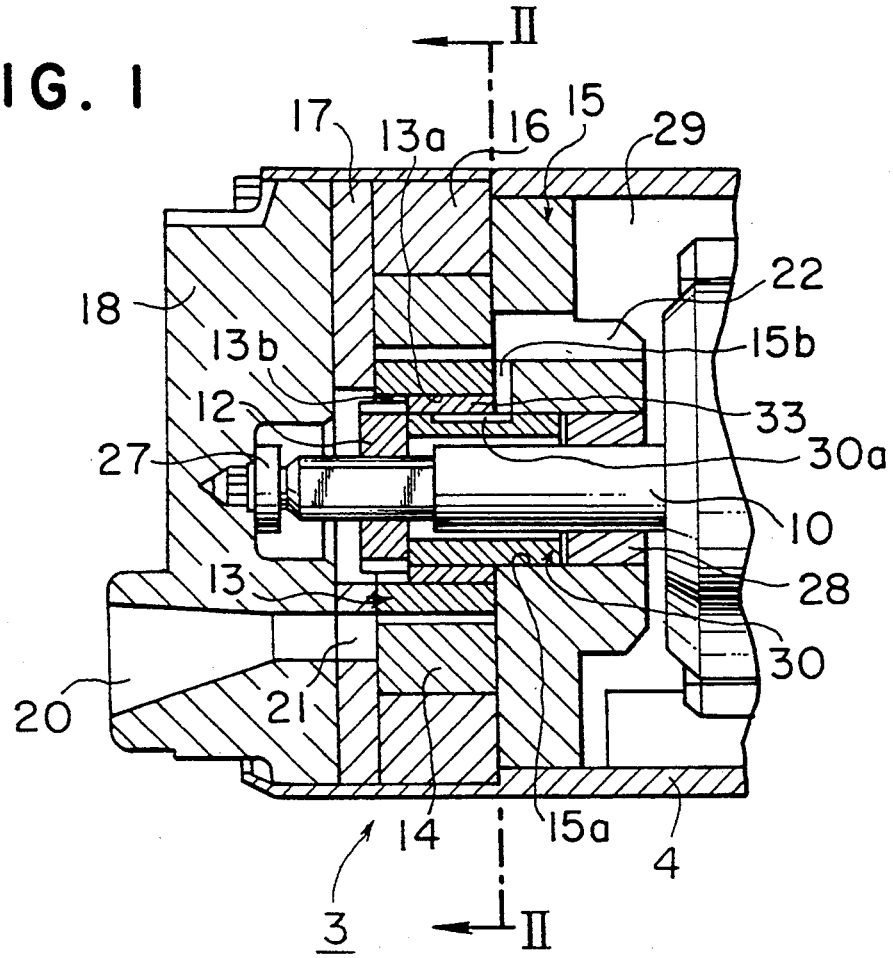
FIG. 1 is a fragmentary cross-sectional view showing a pump according to a first embodiment of the present invention.
Figure 2:
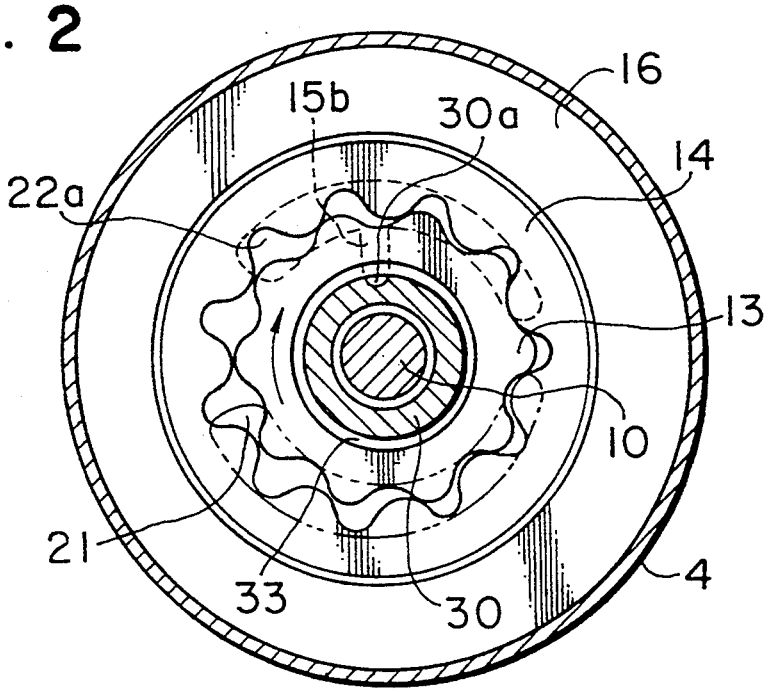
FIG. 2 is a cross-sectional view taken along the line II—II of FIG. 1.
Figure 3:
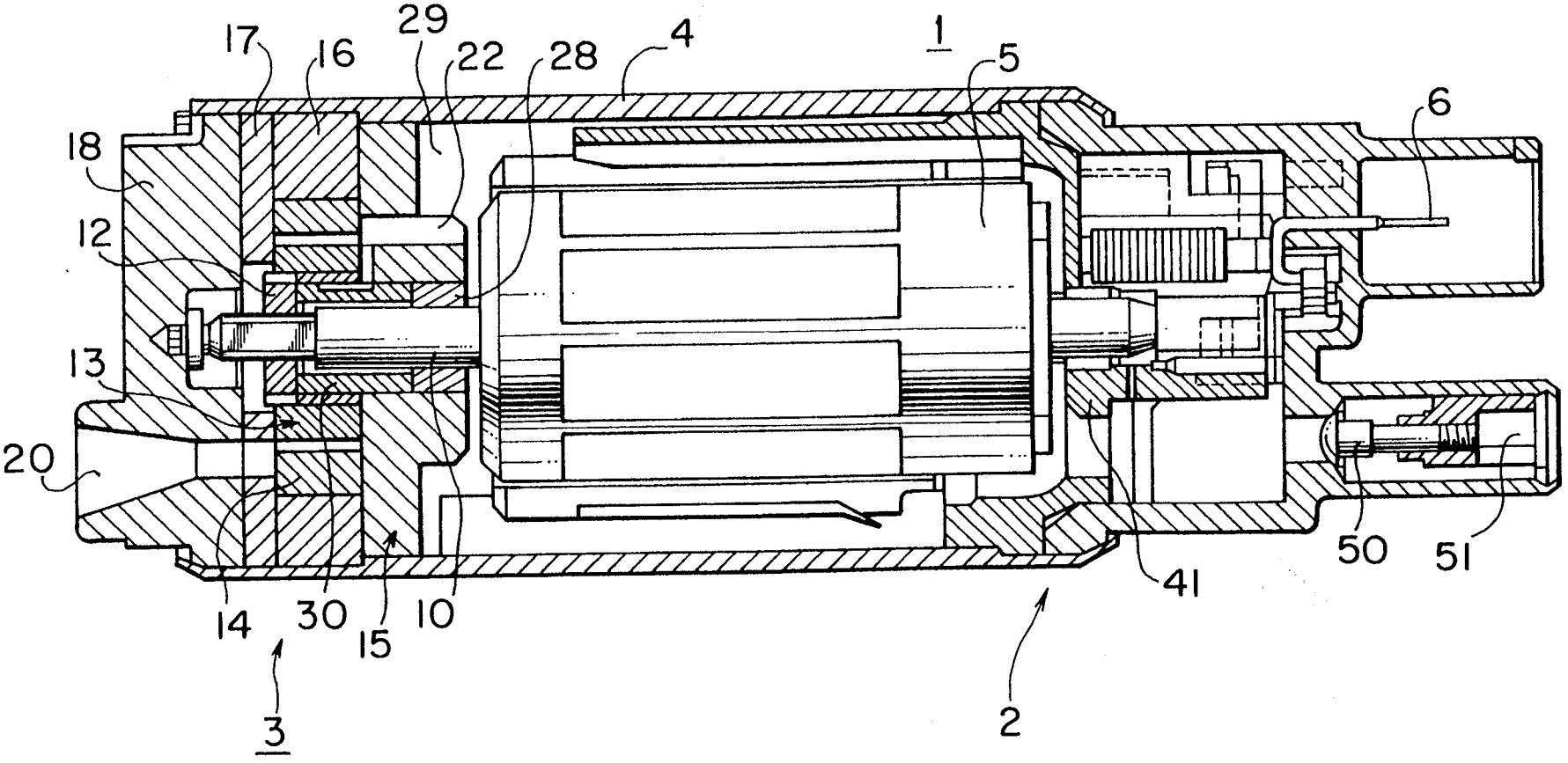
FIG. 3 is a longitudinal cross-sectional view of the pump of the first embodiment.

Referring to FIGS. 1 to 3, a fuel pump 1, which is to be received within a fuel tank of an automobile (not shown) and is dipped in gasoline, comprises a cylindrical housing 4, and a motor portion 2 and a pump portion 3 mounted within the housing 4.

The motor portion 2 includes an armature 5 fixedly mounted on a shaft 10. The shaft 10 is rotatably supported at a motor cover 41 and a casing 15 which are mounted within the housing 4. A feeder terminal 6 is provided on the motor cover 41. A field magnet is fixedly mounted within the housing 4. When electric power is supplied to the feeder terminal 6, the armature 5 is rotated together with the shaft 10.

The pump portion 3 includes an inner rotor 13 rotated by the shaft 10, an outer rotor 14, and a pump casing for accommodating these rotors. The pump portion 3 is mounted within the housing 4.

The pump casing comprises a casing 15, a spacer 16, a spacer cover 17, and a pump cover 18 which are sequentially laminated together.

A bearing through hole 15*a* is formed in the casing 15 to receive a bearing 28 supporting the shaft 10. A bushing 30 is press-fitted in the hole 15*a*.

The spacer 16 has an annular shape, and a center of its inner periphery of a circular shape is eccentric by a predetermined amount from the axis of rotation of the shaft 10.

The outer rotor 14 of a disk-shape has eleven (11) internal teeth formed on the inner periphery thereof, these inner teeth being formed in a trochoid curve. The outer rotor 14 is rotatably received in the spacer 16 with a very small clearance.

A through hole 13*a* is formed at a rotation center of the inner rotor 13. An engagement portion 13*b* engaging a coupling 12 is formed in the through hole 13*a*. A bearing 33 is press-fitted in the through hole 13*a*, and the bushing 30 is rotatably fitted in the bearing 33. Therefore, the inner rotor 13 is positioned coaxially with the shaft 10. On the other hand, ten (10) external teeth arranged in a trochoid curve is formed on the outer periphery of the inner rotor 13. The inner rotor 13 is received in the outer rotor 14 in eccentric relation thereto, and the external teeth of the inner rotor 13 mesh with the internal teeth of the outer rotor 14 to form eleven (11) pump chambers.

The casing 15 forms a side wall of the pump chambers, and as shown in FIG. 2, a groove-like discharge port 22*a* is formed in the casing 15 over a predetermined region. The discharge port 22*a* is communicated with a discharge passage 22 extending through the casing 15. The discharge passage 22 is communicated with a space 29 within the housing 4. This space 29 is communicated with a check valve 50 and a discharge opening 51. The discharge opening 51 is connected to a fuel injection device of the internal combustion engine (not shown).

The coupling 12 is loosely fitted on the distal end portion of the shaft 10 having two parallel opposite flattened surfaces.

The coupling 12 and the engagement portion 13*b* are loosely engaged with each other in such a manner that a relatively large clearance is provided in the direction of rotation of the shaft 10, in the radial direction and in the axial direction. On the other hand, the bushing 30 is close fitted in the bearing 33 with a relatively small clearance, and the inner rotor 13 is positioned with respect to the bushing 30 with a high precision. Therefore, the inner rotor 13 is not influenced by a dislocation of the axis of the shaft 10, and is accurately positioned by the bushing 30.

The spacer cover 17 forms a one side wall of the pump chambers, and as shown in FIG. 2, a groove-like intake port 21 is formed in the spacer cover 17 over a predetermined region.

A thrust bearing 27 for the shaft 10 is fixedly mounted on the pump cover 18, and an intake passage 20, communicated with the intake port 21 formed in the spacer cover 17, is formed in the pump cover 18. A fuel filter (not shown) is provided in the intake passage 20, and the fuel within the fuel tank is drawn through this fuel filter.

In this embodiment, a radial groove 15*b* is formed in the casing 15 forming the other side wall of the pump chambers. One end of the groove 15*b* is communicated with the discharge port 22, and the other end of this groove reaches the outer periphery of the bushing 30. An axial groove 30*a* is formed in the outer periphery of the bushing 30, which communicates with the groove 15*b*. The opposite ends of the groove 30*a* are closed, and the groove 30*a* is disposed generally at the center of the discharge port 22*a*, as shown in FIG. 2.

The operation of this embodiment will now be described.

When electric power is supplied to the feeder terminal 6, the armature 5 and the shaft 10 are rotated. The rotation of the shaft 10 is transmitted to the inner rotor 13 via the coupling 12, so that the inner rotor 13 and the outer rotor 14 in mesh with the inner rotor 13 are rotated in the same direction. In accordance with this rotation, the plurality of pump chambers shown in FIG. 2 are moved in a clockwise direction. In addition, as the pump chambers move in the clockwise direction, the volume of the pump chambers is increasing from the position of 3 o'clock (FIG. 2), and then is decreasing again. Therefore, the fuel is drawn from the intake port 21 formed at the region where the volume of the pump chamber increases. The fuel filled in the pump chambers is discharged from the discharge port 22*a* formed at the region where the volume of the pump chamber decreases. The fuel discharged from the discharge passage 22 to the space 29 opens the check valve 50, and is supplied to the fuel injection device via the discharge opening 51. Since the fuel injection device has a fuel pressure control valve, the pressure of the discharge fuel is adjusted to 1 to 4 kg/cm$^2$. Therefore, the pressure of the discharge port 22*a* is generally equal to this pressure.

The fuel discharged to the discharge port 22 is also introduced into the groove 30*a* via the groove 15*b*. The pressure of the fuel in those pump chambers disposed at the discharge port 22*a* is higher than the pressure of the fuel in those pump chambers disposed at the intake port 21, and therefore a force acting from the upper side to the lower side in FIG. 2 is exerted on the inner rotor 13. Therefore, the bearing 33 of the inner rotor 13 is strongly pressed against the upper portion (FIG. 2) of the bushing 30. In this embodiment, however, the fuel of the discharge pressure is also supplied to the inner peripheral surface of the inner rotor 13 adjacent to the discharge port 22*a*, and therefore the force to press the bearing 33 of the inner rotor 13 against the bushing 30 is reduced.

Therefore, the frictional resistance between the bearing 33 and the bushing 30 is reduced, and the required drive torque for the pump portion 3 is reduced, and therefore the amount of consumption of electric power by the motor portion 2 is reduced. In addition, an excessive wear of the bearing 33 for the inner rotor 13, as well as an irregular wear of the bushing 33, is reduced, so that a dislocation of the inner rotor 13 is prevented. Particularly, since the inner rotor 13 can be supported accurately at the proper position over a long period of time, the predetermined performance can be maintained over a long period of time.

Figure 4:
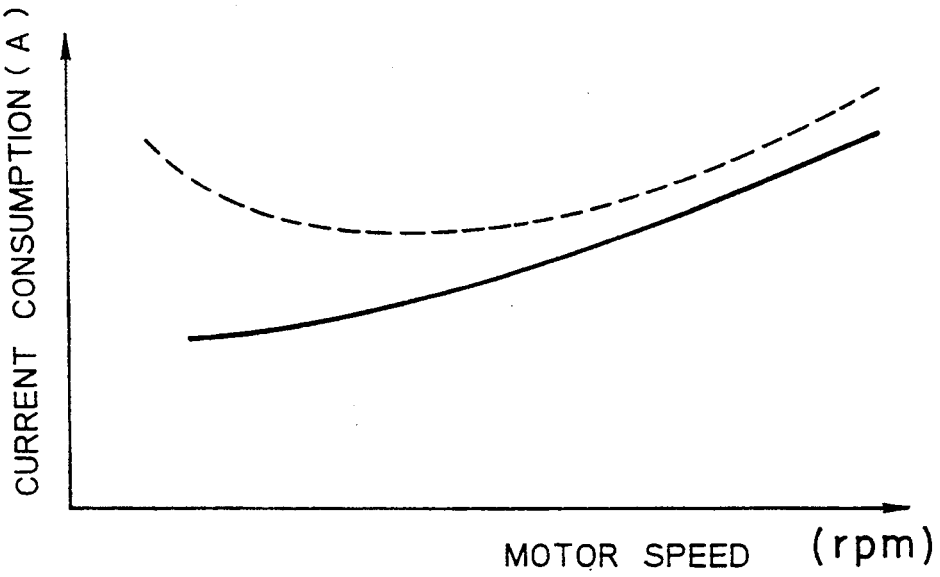
FIG. 4 is a graph showing a comparison between the first embodiment and the prior art.

In this embodiment, the current consumption of the fuel pump 1 can be reduced generally over the entire range of the rotational speed. In FIG. 4, an abscissa represents a motor speed and an ordinate represents a current consumption of the pump. In FIG. 4, a solid line represents the case where the discharge pressure is introduced to the inner side of the inner rotor as in this embodiment, and a broken line represents the case where the inner rotor is merely supported by the bushing as in the prior art. As shown in FIG. 4, when the discharge pressure is supplied to the inner side of the inner rotor, the current consumption is reduced particularly at a low range of the motor speed.

In the above embodiment, although the bearing 33 is press-fitted in the inner rotor 13, the use of this bearing may be omitted. In the above embodiment, although the axial groove 30*a* is formed in the outer peripheral surface of the bushing 30, this groove may be widened in the radial direction. For introducing the discharge fuel pressure between the bearing 33 and the bushing 30, a groove may be formed axially in the inner peripheral surface of the casing 15 so that the discharge fuel pressure can be introduced from the space 29 within the housing 4. In the above embodiment, although the discharge fuel pressure is introduced only to the inner peripheral side of the inner rotor 13, the discharge fuel pressure may be introduced to the outer peripheral side of the outer rotor 14.

A second embodiment of the present invention will be described with reference to FIGS. 5 and 6.

In this second embodiment, a passage for introducing fuel of a discharge pressure to an inner side of an inner rotor is different in shape from that in the first embodiment. In the second embodiment, the fuel of the discharge pressure is introduced also to an outer side of an outer rotor. In the following description, only those portions different from those of the first embodiment will be described, and explanation of those portions identical to those of the first embodiment will be omitted.

Figure 5:
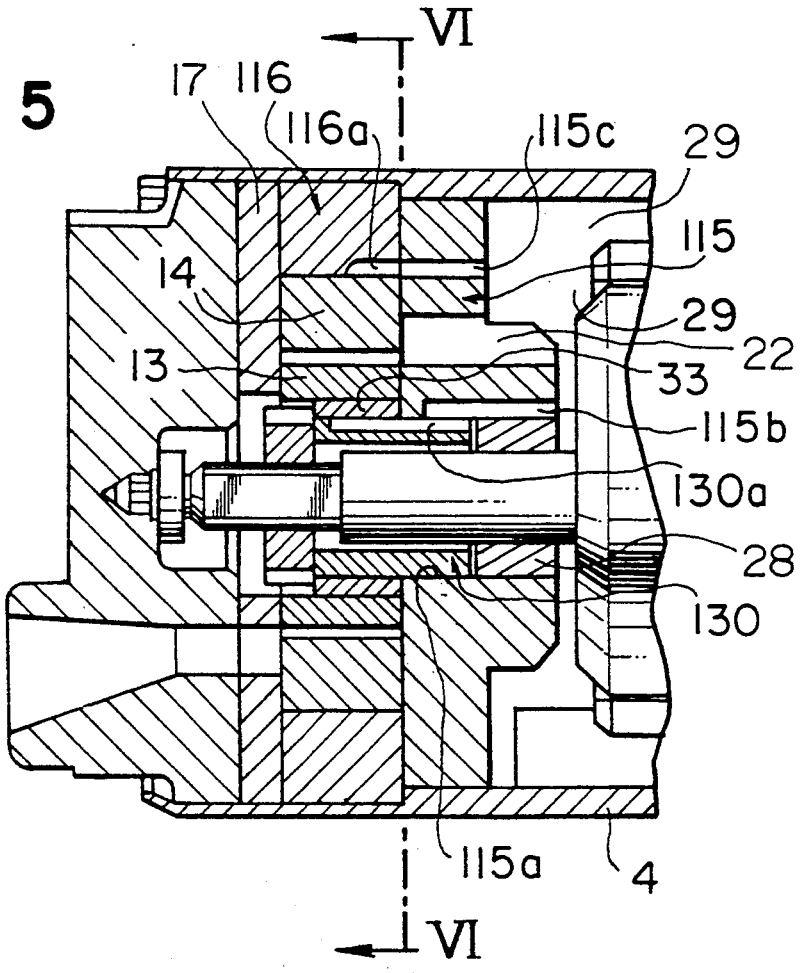
FIG. 5 is a fragmentary cross-sectional view showing a pump according to a second embodiment of the invention.
Figure 6:
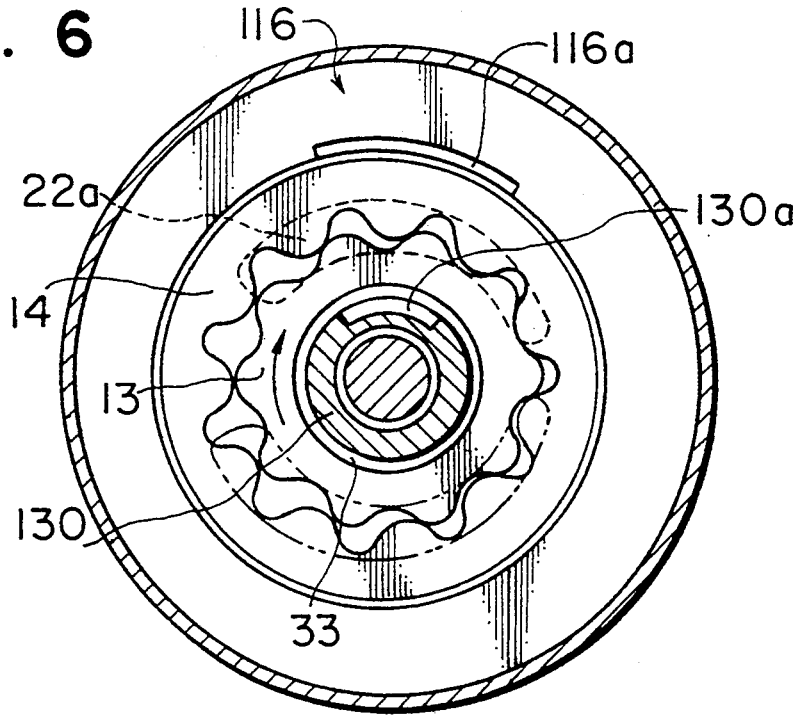
FIG. 6 is a cross-sectional view taken along the line VI—VI of FIG. 5.

In FIG. 5, an axial groove 115*b* is formed in an inner peripheral surface of an annular casing 115. An axial groove 130*a* is formed in an outer peripheral surface of a bushing 130. As shown in FIG. 6, the groove 130*a* also extends circumferentially of the bushing 130 over a predetermined region corresponding to a region where a discharge port 22*a* is formed.

The casing 115 also has a passage 115*c* opened in registry with the boundary between an annular spacer 116 and an outer rotor 14. An axial groove 116*a* is formed in the inner periphery of the spacer 116, and is communicated with the passage 115*c*. As shown in FIG. 6, the groove 116*a* also extends circumferentially of the spacer 116 over a predetermined region corresponding to the region where the discharge port 22*a* is formed.

In the construction of this second embodiment, the fuel of the discharge pressure is introduced into the groove 130*a* from a space 29 of a housing 4 via the groove 115*b*. Also, the fuel of the discharge pressure is introduced into the groove 116*a* from the space 29 of the housing 4 via the passage 115*c*. With this arrangement, the friction between a bearing 33 and the bushing 130 is reduced, and the friction between the outer rotor 14 and the spacer 116 is also reduced. Therefore, in addition to the reduction of the required pump drive torque due to the reduced friction between the bearing 33 and the bushing 130, the reduction of the required pump drive torque due to the reduced friction between the outer rotor 14 and the spacer 116 is achieved, and therefore the power consumption of the motor portion can be reduced. Moreover, not only wear of the bearing 33 and the bushing 130 but also wear of the outer rotor 14 and the spacer 116 can be reduced.

Since the groove 130*a* and the groove 116*a* circumferentially extend over the respective predetermined regions, the fuel can be caused to act on the bearing 33 and the outer rotor 14 over a wider area. Therefore, the friction is further reduced.

In this second embodiment, the fuel of the discharge pressure is introduced from the space 29 of the housing 4 via the groove 115*b* and the passage 115*c*. Therefore, as compared with the first embodiment in which the groove is formed in the side wall of the casing disposed adjacent to the inner rotor 13, the area of the axial end surface of the inner rotor 13 on which the fuel of the discharge pressure acts is reduced. Therefore, in this second embodiment, the force urging the inner rotor 15 axially (from right to left in FIG. 5) can be reduced.

The groove 116*a* formed in the spacer 116 may be short in the circumferential direction. A groove communicated with a discharge passage 22 may be formed in the side wall of the casing 115 disposed adjacent to the inner rotor 13 so that the fuel can be introduced into the groove 116*a* via this groove. The groove 116*a* may be short in the axial direction, in which case the fuel of the discharge pressure acts only on a portion of the outer periphery of the casing 115 disposed adjacent to the casing 115. Instead of forming the groove 116*a*, a passage may be formed in the spacer 116, in which case the fuel of the discharge pressure acts only on a portion of the outer periphery of the outer rotor 14 disposed adjacent to a spacer cover 17 or on a central portion of the outer periphery of the outer rotor 14.

The groove 115*b* formed in the casing 115 may extend axially through the casing 115 to be open at its opposite ends to the opposite end faces of the casing 115. Instead of forming the groove 115*b* in the casing 115, a groove may be formed in an outer periphery of a bearing 28 so that the fuel pressure can be introduced into the groove 130*a*.

A third embodiment will be described with reference to FIGS. 7 and 8.

In this third embodiment, a passage for introducing fuel to an inner side of an inner rotor is different in shape from that in the second embodiment. Also, in this third embodiment, a passage for introducing the fuel to an outer side of an outer rotor is different in shape from that in the second embodiment. In the following description, only those portions different from those of the second embodiment will be described, and explanation of those portions identical to those of the first and second embodiments will be omitted.

Figure 7:
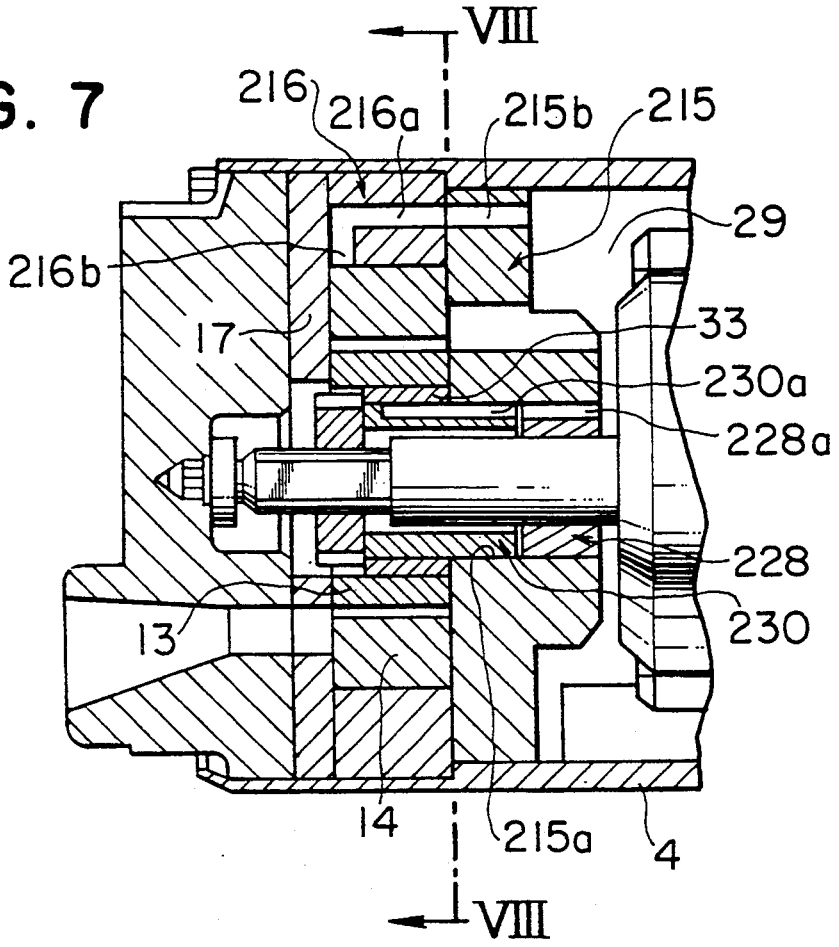
FIG. 7 is a fragmentary cross-sectional view showing a pump according to a third embodiment of the invention.
Figure 8:
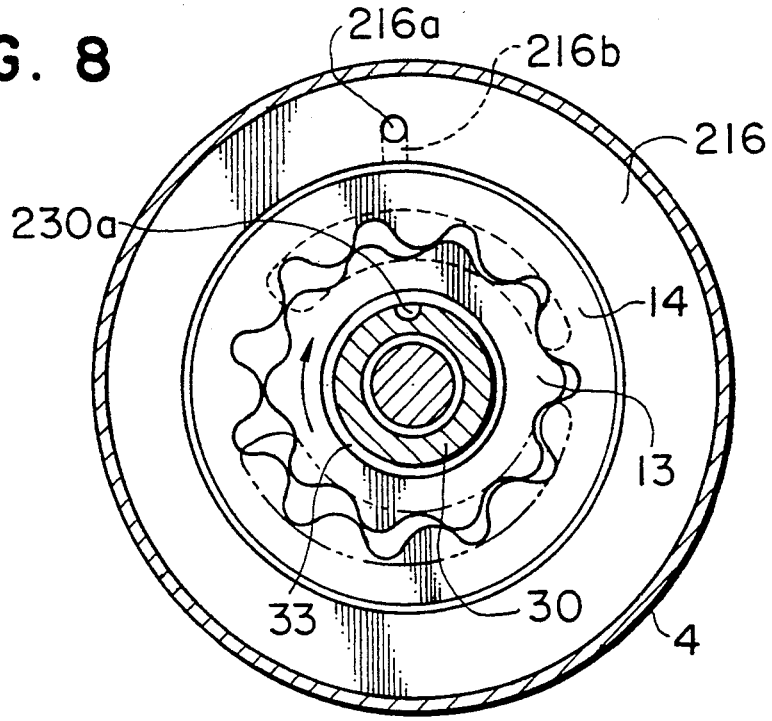
FIG. 8 is a cross-sectional view taken along the line VIII—VIII of FIG. 7.

In FIG. 7, a bearing 228 is press-fitted in a hole 215*a* in a casing 215. An axial groove 228*a* is formed in the outer peripheral surface of the bearing 228. An axial groove 230*a* is formed in an outer peripheral surface of a bushing 230. As shown in FIG. 8, this groove 230*a* has a narrow width.

A passage 215*b* leading to an end face of a spacer 216 is formed through the casing 215. A passage 216*a* is formed axially through the spacer 216, and is disposed in alignment with the passage 215*b*. A groove 216*b* is formed in that end face of the spacer 216 disposed adjacent to a spacer cover 17, and extends radially inwardly from the passage 216*a*. As shown in FIG. 8, this groove 216*b* has a narrow width, and causes a fuel pressure to act on an outer periphery of an outer rotor 14.

In the construction of this third embodiment, the fuel of the discharge pressure is introduced from a space 29 of a housing 4 into the groove 230*a* via the groove 228*a*. Also, the fuel of the discharge pressure is introduced from the space 29 of the housing 4 into the groove 216*b* via the passage 215*b* and the passage 216*a*. With this arrangement, the friction between a bearing 33 and the bushing 230 is reduced, and also the friction between the outer rotor 14 and the spacer 216 is reduced, and therefore the power consumption of a motor portion can be reduced. Furthermore, not only wear of the bearing 33 and the bushing 230 but also wear of the outer rotor 14 and the spacer 216 can be reduced.

Instead of forming the groove 216*b* in the spacer 216, a passage, disposed generally centrally of the width of the spacer 216, may be formed through the spacer 216 from its outer periphery to its inner periphery, in which case this passage is communicated with the passage 216*a* so as to introduce the fuel to the outer periphery of the outer rotor. Alternatively, a groove, extending from the outer periphery to the inner periphery of the spacer 216, may be formed only in the end face of the spacer 216 disposed adjacent to the casing 215, and a groove is formed axially in the outer periphery of the casing 215, in which case the fuel is introduced via these grooves to a portion of the outer periphery of the outer rotor 14 disposed adjacent to the casing 215.

As described above, in the present invention, since the friction between the inner rotor and the support member for the inner rotor can be reduced, wear of the inner rotor and the support member can be reduced, so that the predetermined performance can be maintained for a long period of time. And besides, the frictional resistance between the inner rotor and the support member for the inner rotor can be reduced, so that the required drive torque of the pump portion can be reduced, and therefore the power consumption of the drive means for driving the pump portion can be reduced.

What is claimed is:

1. A gear-type pump comprising:

a disk-like inner rotor having external teeth formed on an outer periphery thereof, said inner rotor having a hole disposed generally at an axis of rotation thereof;

a disk-like annular outer rotor receiving said inner rotor therein, said outer rotor having internal teeth formed on an inner periphery thereof, said internal teeth meshing with said external teeth of said inner rotor to define therebetween a plurality of movable pump chambers, which change in volume to draw and discharge a fluid as said inner and outer rotors rotate;

a casing including a cylindrical wall rotatably receiving said outer rotor, walls forming side confinements for said plurality of pump chambers defined between said inner and outer rotors, an intake port positioned along a path of movement of said pump chambers so as to enable the pump chambers to draw the fluid therethrough, and a discharge port positioned along the path of movement of said pump chambers so as to enable the pump chambers to discharge the fluid therethrough, said fluid discharged through the discharge port being at a higher pressure than the fluid drawn through the intake port;

drive means for rotating said inner and outer rotors; and a support member provided in said hole in said inner rotor for rotatably supporting said inner rotor in eccentric relation to said outer rotor;

said inner rotor and said support member having an inner pressure introduction passage formed therebetween at a position adjacent a mouth of said discharge port so as to be in fluid communication therewith and permit said higher pressure fluid discharged through the discharge port to be introduced between said inner rotor and said support member so that pressure created between said inner rotor and said support member during operation thereof is substantially equal to said higher pressure of the fluid discharged through said discharge port.

2. A gear-type pump according to claim 1, wherein said pressure introduction passage has a first groove formed in said support member.

3. A gear-type pump according to claim 2, wherein said support member has a hollow tubular shape, and is fixedly mounted on said casing.

4. A gear-type pump according to claim 3, wherein said drive means includes a rotatable shaft for driving said inner rotor, which extends through said support member, and a coupling provided between said rotatable shaft and said inner rotor to interconnect them in such a manner as to provide a play in a radial direction.

5. A gear-type pump according to claim 4, wherein said pressure introduction passage has a second groove formed in said casing, said second groove being in communication with said first groove formed in said support member.

6. A gear-type pump according to claim 5, wherein said second groove is formed in a wall of said casing forming the side confinements of said pump chambers.

7. A gear-type pump according to claim 4, wherein a bearing supporting said rotatable shaft is fixedly mounted on said casing, and a communication passage which communicates with said first groove formed in said support member is formed between said casing and said bearing.

8. A gear-type pump according to claim 7, wherein which said communication passage is in the form of a groove in said casing.

9. A gear-type pump according to claim 7, wherein said communication passage is in the form of a groove in said bearing.

10. A gear-type pump according to claim 4, wherein said groove extends circumferentially in said support member over a predetermined region corresponding to the area of the mouth of said discharge port.

11. A gear-type pump according to claim 10, wherein a spacer is provided for defining said cylindrical wall rotatably receiving said outer rotor, and an outer pressure introduction passage for introducing the discharge pressure between said outer rotor and said spacer is provided at a position adjacent to said discharge port so as to be in fluid communication therewith.

12. A gear-type pump according to claim 11, wherein said outer pressure introduction passage comprises a groove which is formed in an inner peripheral surface of said spacer and extends circumferentially about said spacer over a predetermined region, and said outer pressure introduction passage opposes said groove through said inner and outer rotors.

13. A gear-type pump according to claim 1, wherein a spacer is provided for defining said cylindrical wall rotatably receiving said outer rotor, and an outer pressure introduction passage for introducing the discharge pressure between said outer rotor and said spacer is provided at a position adjacent to said discharge port so as to be in fluid communication therewith.

14. A gear-type pump according to claim 13, wherein said outer pressure introduction passage opposes said inner pressure introduction passage through said inner and outer rotors.

15. A gear-type pump according to claim 14, wherein said outer pressure introduction passage is in the form of a groove in said spacer.

16. A gear-type pump assembly comprising:

a cylindrical housing;

a rotatable shaft disposed within said housing a motor mounted within said housing for rotating said shaft; and a pump mounted at one open end of said housing for drawing a fluid from the exterior of said housing and for discharging the fluid to the interior of said housing, said pump including:

(i) a disk-like inner rotor having external teeth formed on an outer periphery thereof, said inner rotor being driven for rotation by said shaft and having a hole formed therein at an axis of rotation thereof;

(ii) a disk-like annular outer rotor receiving said inner rotor therein, said outer rotor having internal teeth formed on an inner periphery thereof, said internal teeth meshing with said external teeth of said inner rotor to define therebetween a plurality of movable pump chambers which change in volume to draw and discharge a fluid as said inner and outer rotors rotate;

(iii) a casing fixedly mounted within said housing, said casing including a cylindrical wall rotatably receiving said outer rotor, walls forming side confinements for said plurality of pump chambers defined between said inner and outer rotors, and intake port positioned along a path of movement of said pump chambers so as to enable the pump chambers to draw the fluid from the exterior of said housing, and a discharge port positioned along the path of movement of said pump chambers so as to enable the pump chambers to discharge the fluid to the interior of said housing, said fluid discharged by the discharge port being at a higher pressure than the fluid drawn by the intake port; and (iv) a support member fixedly mounted on said casing and provided in said hole in said inner rotor for rotatably supporting said inner rotor in eccentric relation to said outer rotor, said inner rotor and said support member having a pressure introduction passage formed therebetween at a position adjacent a mouth of said discharge port so as to be in fluid communication therewith and permit the higher pressure fluid discharged by the discharge port to be introduced between said inner rotor and said support member so that pressure created between said inner rotor and said support member during operation thereof is substantially equal to said higher pressure of the fluid discharged through said discharge port.

17. A gear-type pump assembly according to claim 16, wherein a spacer is provided for defining said cylindrical wall surface rotatably receiving said outer rotor, and the higher pressure fluid discharged by the discharge port also being introduced between said spacer and a said outer rotor.

18. A gear-type pump assembly according to claim 16, wherein the higher pressure fluid discharged by the discharge port is introduced via a groove formed in at least one of said side confinements of said pump chambers.

19. A gear-type pump assembly according to claim 16, wherein the higher pressure fluid discharged by the discharge port is introduced from the interior of said housing via a passage provided between said casing and said support member.

20. A gear-type pump comprising:

a disk-like inner rotor having external teeth formed on an outer periphery thereof, said inner rotor having a hole disposed generally at an axis of rotation thereof;

a disk-like annular outer rotor receiving said inner rotor therein, said outer rotor having internal teeth formed on an inner periphery thereof, said internal teeth meshing with said external teeth of said inner rotor to define therebetween a plurality of movable pump chambers, which change in volume to draw and discharge a fluid as the inner and outer rotors rotate;

a casing including a cylindrical wall rotatably receiving said outer rotor, walls forming side confinements for said plurality of pump chambers defined between said inner and outer rotors, an intake port positioned along a path of movement of said pump chambers so as to enable the pump chambers to draw the fluid therethrough, and a discharge port positioned along the path of movement of said pump chambers so as to enable the pump chambers to discharge the fluid therethrough, said fluid discharged through the discharge port being at a higher pressure than the fluid drawn through the intake port;

drive means for rotating said inner and outer rotors; and a support member provided in said hole in said inner rotor for rotatably supporting said inner rotor in eccentric relation to said outer rotor, said inner rotor and said support member having an inner pressure introduction passage formed therebetween, and said outer rotor and said cylindrical wall having an outer pressure introduction passage formed therebetween, said inner and outer pressure introduction passages being disposed at a position adjacent a mouth of said discharge port so as to be in fluid communication therewith and permit said higher pressure fluid of the discharge port to be introduced therein so that pressure created between said inner rotor and said support member during operation thereof is substantially equal to said higher pressure of the fluid discharged through said discharge port.

* * * * *